US006066075A

United States Patent [19]

Poulton

[11] Patent Number: 6,066,075

[45] Date of Patent: May 23, 2000

[54] DIRECT FEEDBACK CONTROLLER FOR USER INTERACTION

[76] Inventor: Craig K. Poulton, 2232 Melodie Ann Way, Salt Lake City, Utah 84124

[21] Appl. No.: 08/999,487

[22] Filed: Dec. 29, 1997

Related U.S. Application Data

[62] Division of application No. 08/507,550, Jul. 26, 1995, Pat. No. 5,702,323.

[51] Int. Cl.[7] ..... A61B 5/04

[52] U.S. Cl. ..... 482/8; 482/1; 482/9; 482/900

[58] Field of Search ..... 482/1–9, 900–902; 601/23

[56] References Cited

U.S. PATENT DOCUMENTS 5,273,038 12/1993 Beavin ..... 600/416
5,277,197 1/1994 Church ..... 600/546
5,549,646 8/1996 Reiss ..... 607/48

*Primary Examiner*—Glenn E. Richman
*Attorney, Agent, or Firm*—Madson & Metcalf

[57] ABSTRACT

An apparatus and method for providing stimuli to a user while sensing the performance and condition of the user may rely on a controller for programmably coordinating a tracking device and a sensory interface device. The tracking device may be equipped with sensors for sensing position, displacement, motion, deflection, velocity, speed, temperature, humidity, heart rate, internal or external images, and the like. The sensory interface device may produce outputs presented as stimuli to a user. The sensory interface device may include one or more actuators for providing aural, optical, tactile, and electromuscular stimulation to a user. The controller, tracking device, and sensory interface device may all be microprocessor controlled for providing coordinated sensory perceptions of complex events.

20 Claims, 5 Drawing Sheets

DIRECT FEEDBACK CONTROLLER FOR USER INTERACTION

RELATED APPLICATIONS

This application is a Divisional application of co-pending U.S. patent application Ser. No. 08/507,550, filed Jul. 26, 1995, U.S. Pat. No. 5,702,323, and directed to an ELECTRONIC EXERCISE ENHANCER.

BACKGROUND

1. The Field of the Invention

This invention relates to exercise equipment and, more particularly, to novel systems and methods for enhancing exercises by providing to a user multiple stimuli and by tracking multiple responses of a user, all with programmable electronic control.

2. The Background Art

Exercise continues to be problematic for persons having limited time and limited access to outdoor recreational facilities or large indoor recreational facilities. Meanwhile, more, and more realistic, simulated, training environments are needed for lower cost instruction and practice.

For example, flight training requires a very expensive aircraft. Nuclear plant control requires a complex system of hardware and software. Combat vehicle training, especially large force maneuvers, requires numerous combat vehicles and supporting equipment. Personal fitness may require numerous machines of substantial size and sophistication placed in a large gym to train athletes in skill or strength, especially if all muscle groups are to be involved. In short, training with real equipment may require substantial real estate and equipment, with commensurate cost.

Many activities may by taught, practiced and tested in a simulated environment.

However, simulated environments often lack many or even most of the realistic stimuli received by a user in the real world including motions over distance, forces, pressures, sensations, temperatures, images, multiple views in the three-dimensions surrounding a user, and so forth. Moreover, many simulations do not provide the proper activities for a user, including a full range of motions, forces, timing, reflexes, speeds, and the like.

What is needed is a system for providing to a user more of the benefits of a real environment in a virtual environment. Also needed is a system for providing coordinated, synchronized, sensory stimulation by multiple devices to more nearly simulate a real three-dimensional spatial environment. Similarly needed is an apparatus and method for tracking a plurality of sensors monitoring a user's performance, integrating the inputs provided by such tracking, and providing a virtual environment simulating time, space, motion, images, forces and the like for the training, conditioning, and experience of a user.

Likewise needed is more complete feedback of a user's condition and responses. Such feedback to a controller capable of changing the stimuli and requirements (such as images, electromuscular and audio stimulation, loads and other resistance to movement, for example) imposed on a user is needed to make training and exercise approach the theoretical limits of comfort, endurance, or optimized improvement, as desired. Moreover, a system is needed for providing either a choice or a combination of user control, selectable but pre-programmed (template-like or open loop) control, and adaptive (according to a user's condition, comfort, or the like) control of muscle and sensory stimulation, resistances, forces, and other actuation imposed on a user by the system, according to a user's needs or preferences.

BRIEF SUMMARY AND OBJECTS OF THE INVENTION

In view of the foregoing, it is a primary object of the present invention to provide for a user an apparatus and method for performing coordinated body movement, exercises, and training by a combination of stimuli to a user, tracking of user activity and condition, and adaptive control of the stimuli according to tracking outputs and to selections made by a user.

It is an object of the invention to provide an apparatus for training a user, including an actuation device for presenting to a user a stimulus sensible by a user.

It is an object of the invention to provide a controller operably connected to an actuation device for controlling the actuation device.

It is an object of the invention to provide a tracking device operably connected to communicate feedback data to a controller and including a sensor for detecting a condition of a user.

It is an object of the invention to provide an electromuscular stimulation device comprising a receiver for receiving input signals corresponding to user inputs selected by a user and to feedback data reflecting a detected condition of a user, the electromuscular stimulation device being operably connected to a controller to provide stimulation directly to a user as determined by the controller.

It is an object of the invention to provide a tracking device having one or more sensors selected from a position detector, motion sensor, accelerometer, radar receiver, force transducer, pressure transducer, temperature sensor, heart rate detector, humidity sensor, and imaging sensor.

It is an object of the invention to provide an imaging sensor selected from a magnetic resonance imaging device, a sonar imaging device, an ultrasonic imaging device, an x-ray imaging device, an imaging device operating in the infrared imaging spectrum, an imaging device operating in the ultraviolet spectrum, an imaging device operating in the visible light spectrum, a radar imaging device, and a tomographic imaging device.

It is an object of the invention to provide a transducer for detecting a condition of a user, the condition being selected from a spatial position, a relative displacement, a velocity, a speed, a force, a pressure, an environmental temperature, and a pulse rate corresponding to a bodily member of a user.

It is an object of the invention to provide a sensor adapted to detect a position of a bodily member of a user.

It is an object of the invention to provide an instrumented, movable member incorporated into an article of body wear placeable over a bodily member of the user.

It is an object of the invention to provide a sensor for detecting a position of a bodily member of a user and selected from a radar receiver, a gyroscopic device for establishing spatial position, a global positioning system detecting a target positioned on the bodily member from three sensors spaced from one another and from the bodily member, and an imaging system adapted for detecting, recording, and interpreting positions of bodily members of a user and processing data corresponding to the positions to provide outputs from the tracking device to the controller.

It is an object of the invention to provide a method of exercising to include inputting a process parameter signal corresponding to data required by an executable program, a user selection signal corresponding to optional data selectable by a user and useable by the executable program, and data corresponding to a condition of a user as detected by a tracking device.

It is an object of the invention to provide computer processing of a process parameter signal, a user selection signal, and a sensor signal from a tracking device to control an actuator providing to a bodily member of a user a stimulus corresponding to the process parameter signal, the user selection signal, and the sensor signal.

It is an object of the invention to provide a method of exercising to include setting a control of an electromuscular stimulation device to deliver sensory impact to muscles of a user at interactively determined times, in accordance with settings input by a user, pre-programmed control parameters, and feedback signals corresponding to a selected condition of a user provided from a sensor of a tracking device.

Consistent with the foregoing objects, and in accordance with the invention as embodied and broadly described herein, an electronically controlled exercise enhancer is disclosed in one embodiment of the present invention as including an apparatus having a controller with an associated processor for controlling stimuli delivered to a user and for receiving feedback corresponding to responses of a user. A tracking device may be associated with the controller to communicate with the controller for tracking responses of a user and for providing to the controller certain data corresponding to the condition, exertion, position, and other characteristics of a user.

The tracking device may also include a processor for processing signals provided by a plurality of sensors and sending corresponding data to the controller. The plurality of sensors deployed to detect the performance of a user may include, for example, a radar device for detecting position, velocity, motion, or speed; a pressure transducer for detecting stress; strain gauges for detecting forces, motion, or strain in a member of the apparatus associated with performance of a user. Such performance may include strength, force applied to the member, deflection, and the like. Other sensors may include humidity sensors; temperature sensors; calorimeters for detecting energy dissipation, either by rate or integrated over time; a heart rate sensor for detecting pulse; and an imaging device. The imaging device may provide for detecting the position, velocity, or condition of a member. Imaging may also assess a condition of a plane, volume, or an internal or external surface of a bodily member of a user.

One or more sensors may be connected to provide analog or digital signals to the tracking device for processing. The tracking device may then transfer corresponding digital data to the controller. In one embodiment, the controller may do all signal processing, whereas in other embodiments, distributed processing may be relied upon in the tracker, or even in individual sensors to minimize the bandwidth required for the exchange of data between devices in the apparatus.

A stimulus interface device may be associated with the controller for delivering selected stimuli to a user. The stimulus interface device may include a processor for controlling one or more actuators (alternatively called output devices) for providing stimulus to a user. Alternatively, certain actuators may also contain processors for certain functions, thus reducing the bandwidth required for communications between the controller and the output devices. Alternatively, for certain embodiments where processing capacity in and communications capacity from the controller are adequate, the controller may provide processing for data associated with certain actuators.

Actuators for the sensory interface device may include aural actuators for presenting sounds to a user, such as speakers, sound synthesizers with speakers, compact disks and players associated with speakers for presenting aural stimuli, or electrodes for providing electrical impulses associated with sound directly to a user.

Optical actuators may include cathode ray tubes displaying images in black and white or color, flat panel displays, imaging goggles, or electrodes for direct electrical stimulus delivered to nerves or tissues of a user. Views presented to a user may be identical for both eyes of a user, or may be stereoscopic to show the two views resulting from the parallax of the eyes, thus providing true three-dimensional images to a user.

In certain embodiments, the actuators may include temperature actuators for providing temperature or heat transfer. For example working fluids warmed or cooled to provide heat transfer, thermionic devices for heating and cooling an junction of a bimetallic probe, and the like may be used to provide thermal stimulus to a user.

Kinematic actuators may provide movement in one or more degrees of freedom, including translation and rotation with respect to each of the three spatial axes. Moreover, the kinematic actuators may provide a stimulus corresponding to motion, speed, force, pressure or the like. The kinematic actuators may be part of a suite of tactile actuators for replicating or synthesizing stimuli corresponding to each tactile sensation associated with humans' sense or touch of feel.

In general a suite of tactile, optical, and aural, and even olfactory and taste actuators may replicate virtually any sensible output for creating a corresponding sensation by a user. Thus, the tracking device may be equipped with sensors for sensing position, displacement, motion, deflection, velocity, speed, temperature, pH, humidity, heart rate, images, and the like for accumulating data. Data may correspond to the biological condition and spatial kinematics (position, velocity, forces) of a bodily member of a user. For example, skin tension, pressure, forces in any spatial degree of freedom and the like may be monitored and fed back to the controller.

The sensory interface device may produce outputs presented as stimuli to a user. The sensory interface device may include one or more actuators for providing aural, optical, tactile, and electromuscular stimulation to a user. The controller, tracking device, and sensory interface device may all be microprocessor controlled for providing coordinated sensory perceptions of complex events. For example, actuators may represent a coordinated suite of stimuli corresponding to the sensations experienced by a user. For example, a user may experience a panoply of sensory perceptions besides sight.

For example, sensations may replicate, from synthesized or sampled data, a cycling tour through varied terrain and vegetation, a rocket launch, a tail spin in an aircraft, a flight by aircraft including takeoff and landing. Sensations may be presented for maneuvers such as aerobatics.

A combat engagement may be experienced from within a combat vehicle or simulator. Sensory inputs may include those typical of a turret with slewing control and mounting weaponry with full fire control. Besides motion, sensory inputs may include hits received or made. Sensations may imitate or replicate target acquisition, tracking, and sensing or the like.

Moreover, hand-to-hand combat with a remote user operating a similar apparatus may be simulated by the actuators. Sensors may feed back data to the controller for forwarding to the system of the remote user, corresponding to all the necessary actions, condition, and responses of the user.

Similarly, a mountain hike, a street patrol by police, a police fire fight, an old west gunfight, a mad scramble over rooftops, through tunnels, down cliffs, and the like may all be simulated with properly configured and powered actuators and sensors.

Stimuli provided to a user may be provided in a variety of forms, including electromuscular stimulation. Stimuli may by timed by a predetermined timing frequency set according to a pre-programmed regimen set by a user or a trainer as an input to an executable code of a controller.

Alternatively, stimuli may be provided with interactively determined timing.

Interactively determined timing for electromuscular stimulation means that impulses may be timed and scaled in voltage, frequency, and other parameters according to a user's performance.

For example, detection is possible for the motion, speed, position, muscular or joint extension, muscle tension or loading, surface pressure, or the like. Such detection may occur for many body members. Members may include a user's foot, arm, or other bodily member.

Sensed inputs may be sensed and used in connection with other factors to control the timing and effect of electromuscular stimulation. The electromuscular stimulation may be employed to enhance the contraction or extension of muscles beyond the degree of physiological stimulation inherent in the user. Moreover, sensory impact may be provided by actuators electrically stimulating muscles or muscle groups to simulate forces imposed on bodily members by outside influences. Thus, a virtual baseball may effectively strike a user. A martial arts player may strike another from a remote location by electromuscular stimulation.

That is, in general, two contestants may interact although physically separated by some distance. Thus two contestants may engage in a boxing or martial arts game or contest in which a hit by one contestant faced with a virtual opponent is felt by the opponent. For example, sensory inputs may be provided based on each remote opponents actual movements. Thus impacts may be literally felt by each opponent at the remote location. Likewise, responses of each opponent may be presented as stimuli to each opponent (user).

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the FIGS. 1–5 herein, could be arranged and designed in a wide variety of different configurations. Thus, the following more detailed description of the embodiments of the system and method of the present invention, as represented in FIGS. 1 through 5, is not intended to limit the scope of the invention, as claimed, but it is merely representative of certain presently preferred embodiments of the invention.

Figure 1:
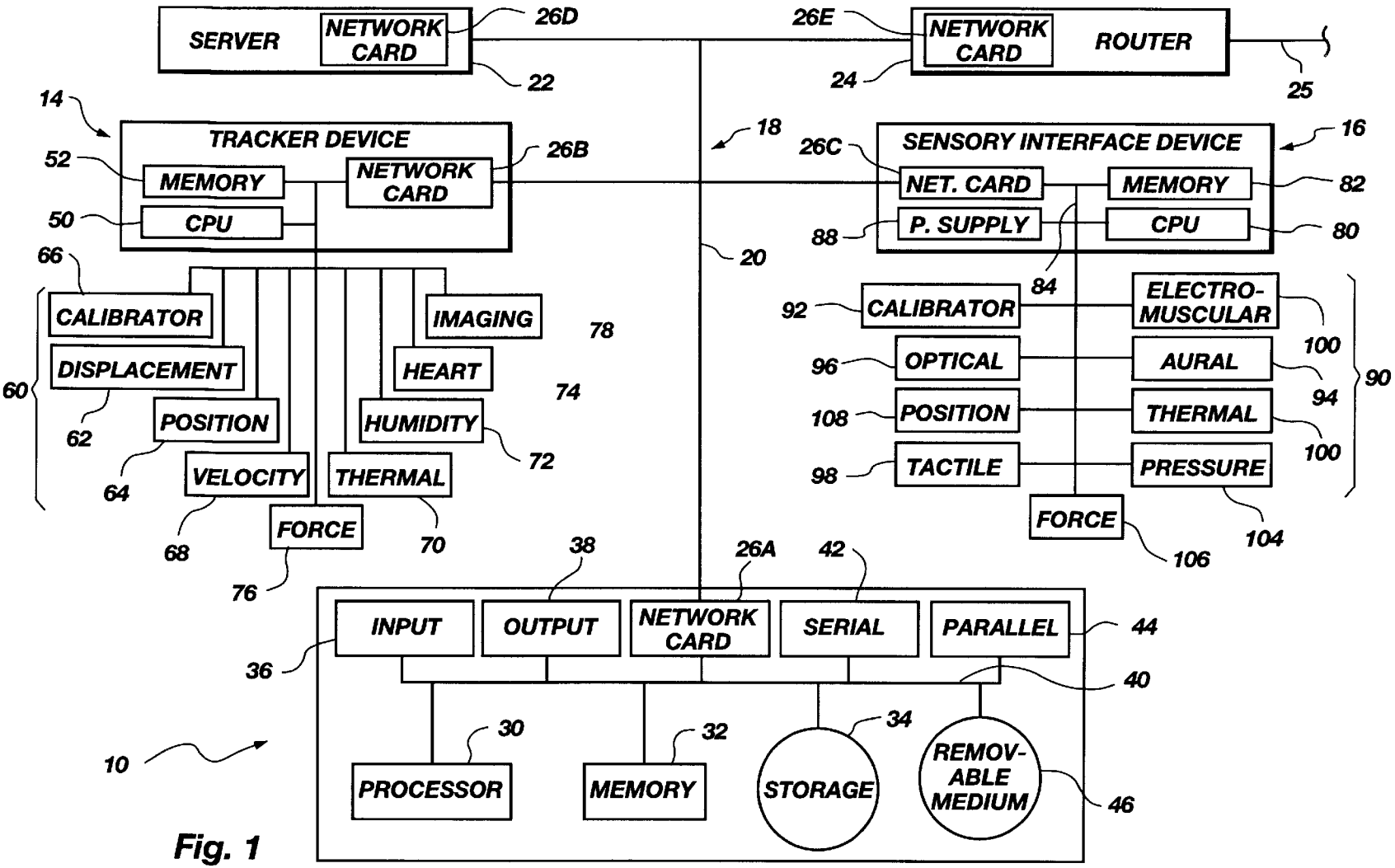
FIG. 1 is a schematic block diagram of an apparatus made in accordance with the invention.

The presently preferred embodiments of the invention will be best understood by reference to the drawings, wherein like parts are designated by like numerals throughout. FIG. 1 illustrates one embodiment of a controller for programmably directing the operation of an apparatus made in accordance with the invention, a tracking device for sensing and feeding back to the controller the condition and responses of a user, and a sensory interface device for providing stimuli to a user through one or more actuators.

Figure 2:
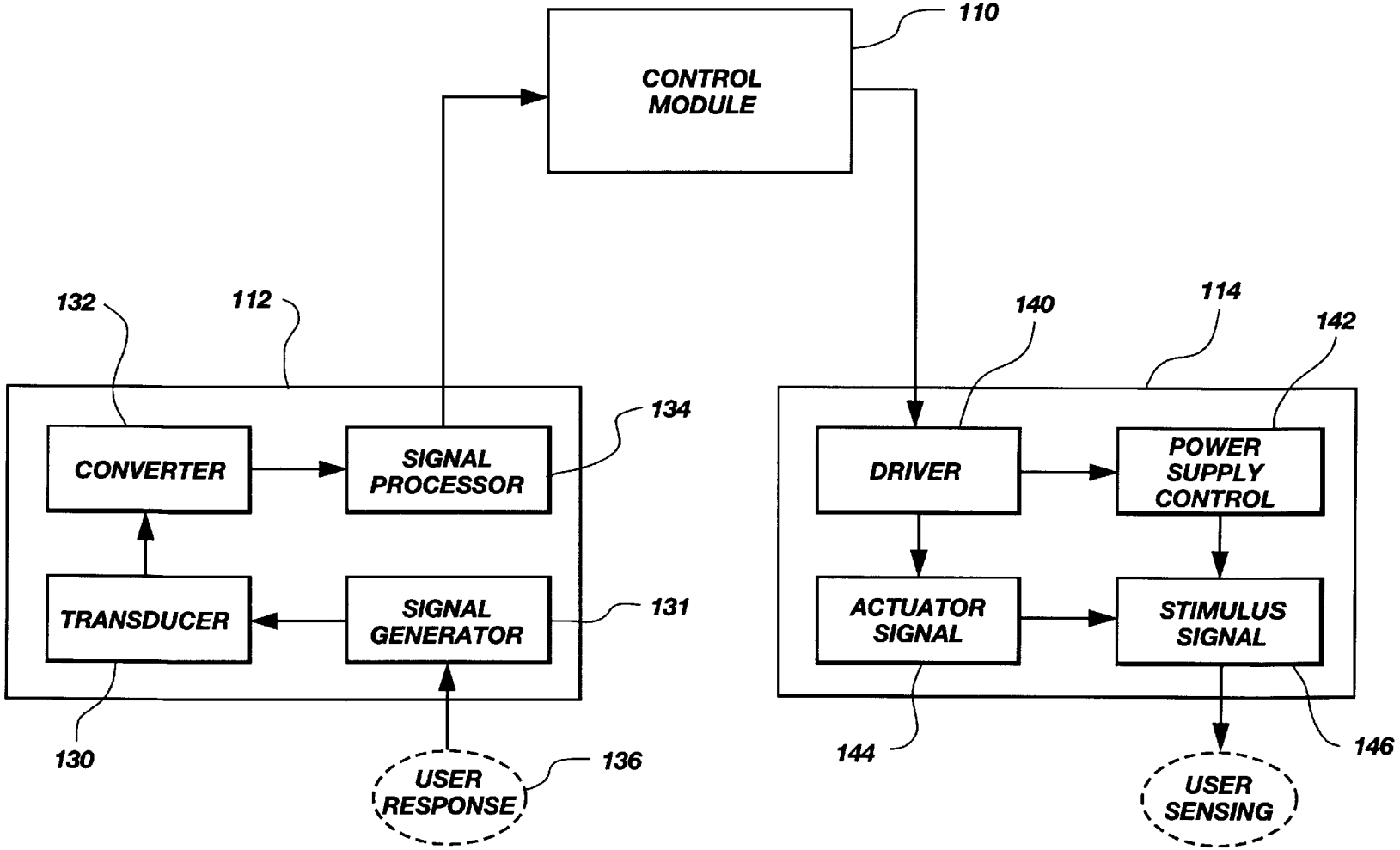
FIGS. 2–3 are schematic block diagrams of software modules for programmable operation of the apparatus of FIG. 1.
Figure 3:
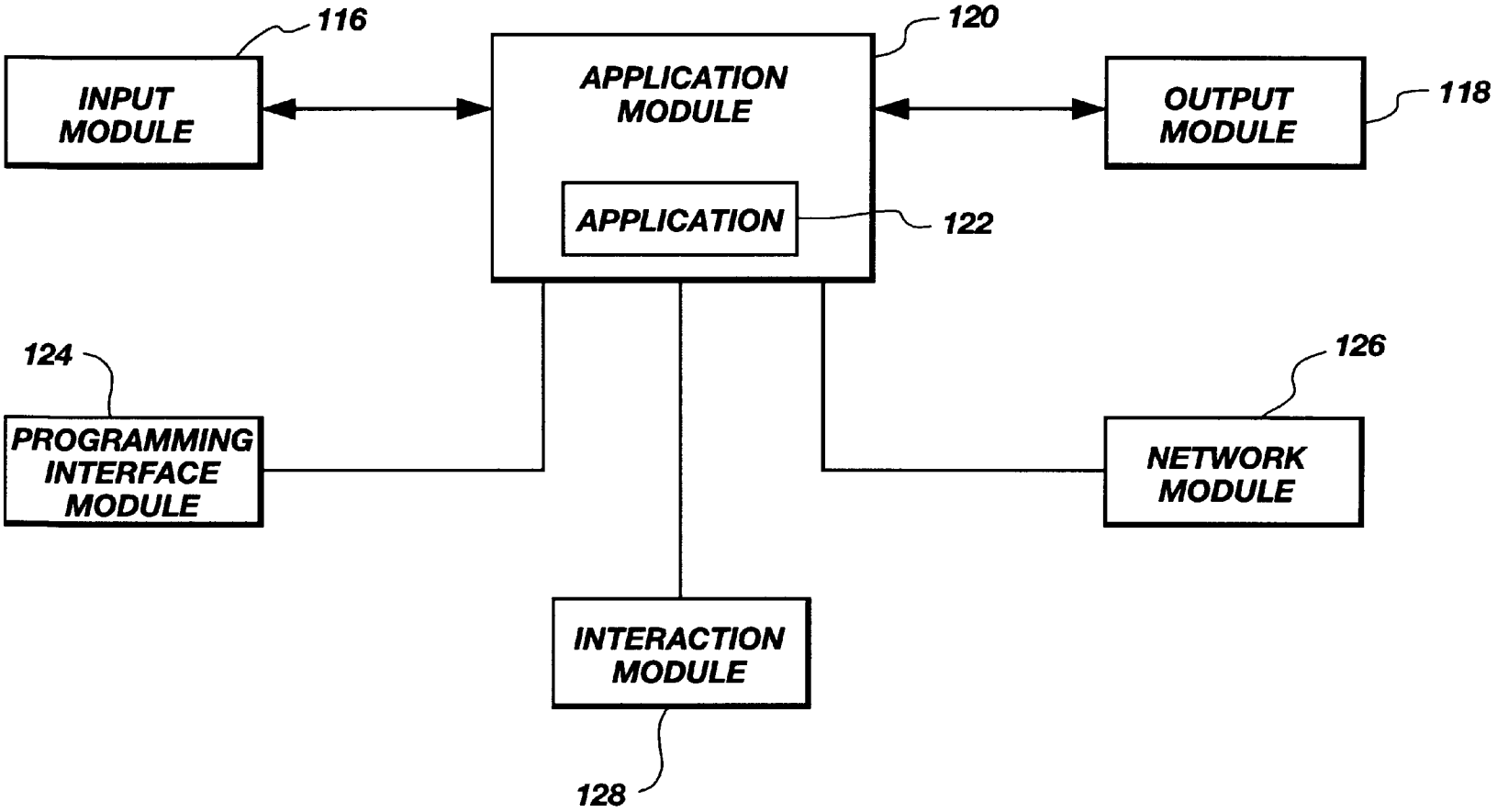
Figure 4:
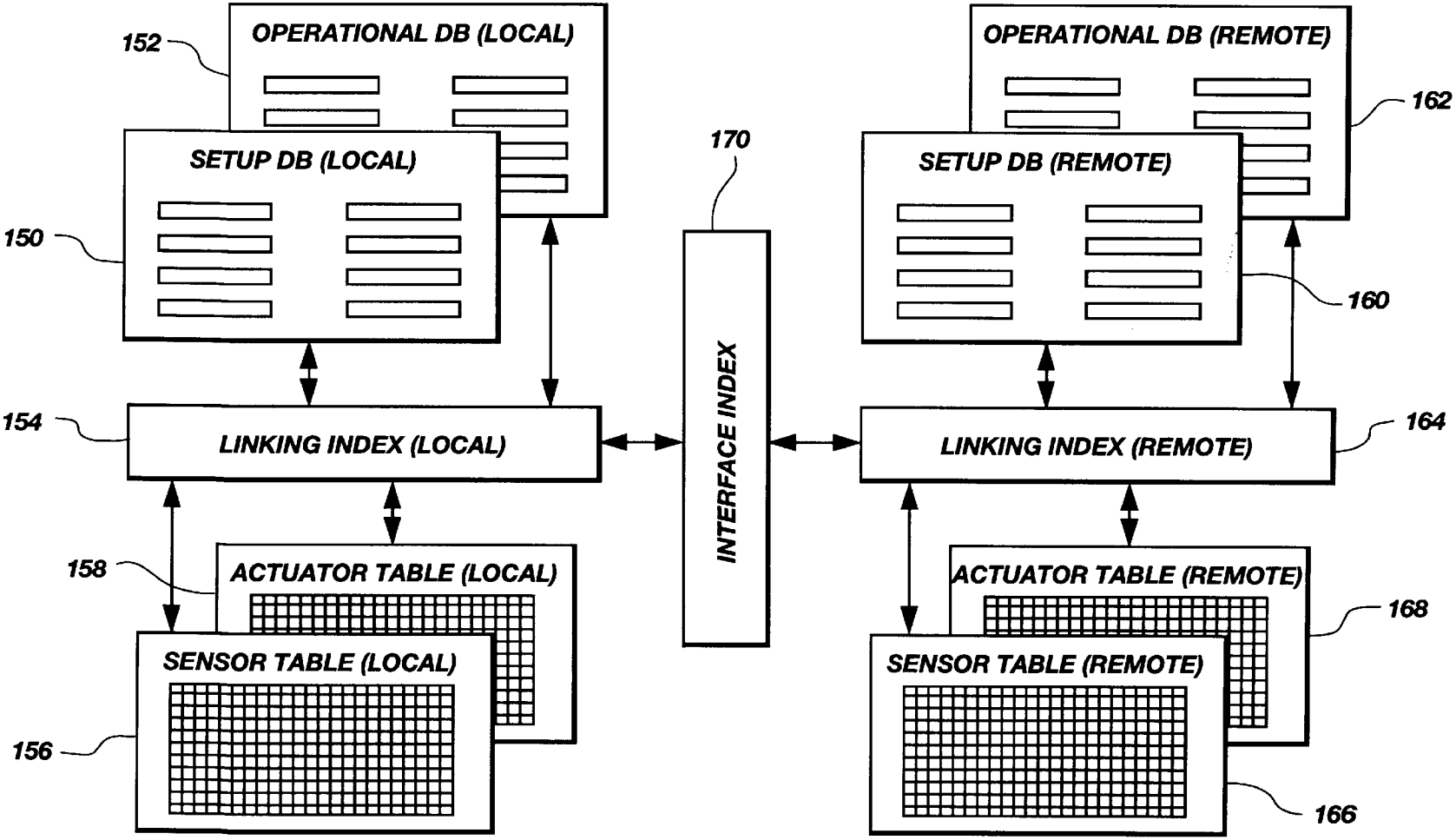
FIG. 4 is a schematic block diagram of one embodiment of the data structures associated with the apparatus of FIG. 1 and the software modules of FIGS. 2–3.

Reference is next made to FIG. 2, which illustrates in more detail a schematic diagram of one preferred embodiment of software programming modules for the tracking device with its associated sensors, and for the sensory interface device with its associated actuators for providing stimuli to a user. FIG. 3 illustrates in more detail a schematic diagram of one preferred embodiment of software modules for programming the controller of FIG. 1. FIG. 4 illustrates a schematic block diagram of one embodiment of data structures for storing, retrieving and managing data used and produced by the apparatus of FIG. 1.

Those of ordinary skill in the art will, of course, appreciate that various modifications to the detailed schematic diagrams of FIGS. 1–4 may easily be made without departing from the essential characteristics of the invention, as described in connection with the block diagram of FIG. 1 above. Thus, the following description of the detailed schematic diagrams of FIGS. 2–5 is intended only as an example, and it simply illustrates one presently preferred embodiment of an apparatus and method consistent with the foregoing description of FIG. 1 and the invention as claimed herein.

From the above discussion, it will be appreciated that the present invention provides an apparatus for presenting one or more selected stimuli to a user, feeding back to a controller the responses of a user, and processing the feedback to provide a new set of stimuli.

Referring now to FIG. 1, the apparatus 10 made in accordance with the invention may include a controller 12 for exercising overall control over the apparatus 10 or system 10 of the invention. The controller 12 may be connected to communicate with a tracking device 14 for feeding back data corresponding to performance of a user. The controller 12 may also connect to exchange data with a sensory interface device 16.

The sensory interface device 16, may include one or more mechanisms for presenting sensory stimuli to a user. The controller 12, tracking device 14 and interface device 16 may be connected by a link 18, which may include a hardware connection and software protocols such as the general purpose interface bus (GPIB) as described in the IEEE 488 standard, and commonly used as a computer bus.

Alternatively, the link 18 may be selected from a universal ace synchronous receiver-transmitter. Since such a system may include a module composed of a single integrated circuit for both receiving and transmitting, asynchronously through a serial communications port, this type of link 18 may be simple, reliable, and inexpensive. Alternatively, a universal synchronous receiver-transmitter (USRT) module may be used for communication over a pair of serial channels. Although slightly more complex, such a link 18 may be used to pass more data.

Another alternative, for a link 18 is a network 20, such as a local area network. If the controller 12, tracking device 14 and sensory interface device 16 are each provided with some processor, then each may be a node on the network 20. Thus, a server 22 may be connected to the network 20 for providing data storage, and general file access for any processor in the system 10.

A router 24 may also be connected to the network 20 for providing access to a larger internetwork, such as the worldwide web or internet. The operation of servers 22 and routers 24 reduce the duty required of the controller 12, and may also permit interaction between multiple controllers 12 separated across internetworks. For use of an apparatus 10 in an interactive mode, wherein interactive means interaction between users remotely spaced from one another, an individual user might have a substantially easier task trying to find a similarly situated partner for interactive games. Moreover, real-time interaction, training, and teaming between users located at great distances may be accomplished using the system 10.

The network interface cards 26A, 26B, 26C, 26D, 26E, may be installed in the controller 12, tracking device 14, sensory interface device 16, server 22, and router 24, respectively, for meeting the hardware and software conventions and protocols of the network 20.

The controller 12 may include a processor 30 connected to operate with a memory device 32. Typically, a memory device 32 may be a random access memory or other volatile memory used during operation of the processor 30. Long term memory of software, data, and the like, may be accommodated by a storage device 34 connected to communicate with the processor 30.

The storage device 34 may be a floppy disk drive, a random access memory, but may in one preferred embodiment of the system 10 include one or more hard drives. The storage device 34 may store applications, data bases, and various files needed by the processor 30 during operation of the system 10. The storage device 34 may download from the server 22 according to the needs of the controller 12 in any particular specific task, game, training session, or the like.

An input device 36 may be connected to communicate with a processor 30. For example, a user may program a processor 30 by creating an application to be stored in the storage device 34 and run on the processor 30. An input device 36, therefore, may be a keyboard. Alternatively, the input device 36 may be selected from a capacitor membrane keypad, a graphical user interface such as a monitor having menus and screens, or icons presented to a user for selection. An input device, may include a graphical pad and stylus for use by a user inputting a figure rather than text or ASCII characters.

Similarly, an output device 38 may be connected to the processor 30 for feeding back to a user certain information needed to control the controller 12 or processor 30. For example, a monitor may be a required output device 38 to operate with the menu and icons of an input device 36 hosted on the same monitor.

Also, an output device may include a speaker for producing a sound to indicate that an improper selection, or programming error has been committed by a user operating the input device 36 to program the processor 30. Numerous input device 36 and output devices 38 for interacting with the processor 30 of the controller 12 are available, and within contemplation of the invention.

The processor 30, memory device 32, storage device 34, input device 36, and output device 38 may all be connected by a bus 40. The bus may be of any suitable type such as those used in personal computers or other general purpose digital computers. The bus may also be connected to a serial port 42 and a parallel port 44 for communicating with other peripheral devices selected by a user. For example, a parallel port 44 may connect to an additional storage device, a slaved computer, a master computer, or a host of other peripheral devices.

In addition, a removable media device 46 may be connected to the bus 40.

Alternatively, a removable media device such as a floppy disk drive, a Bernoulli™ drive, an optical drive, a compact disk laser readable drive, or the like could be connected to the bus 40 or to one of the ports 42, 44. Thus, a user could import directly a software program to be loaded into the storage device 34, for later operation on the processor 30.

In one embodiment, the tracking device 14 and the sensory interface device 16 may be "dumb" apparatus. That is, the tracking device 14 and sensory interface device 16 might have no processors contained within their hardware suites. Thus, the processor 30 of the controller 12 may do all processing of data exchanged by the tracking device, sensory interface device, and controller 12. However, to minimize the required bandwidths of communication lines such as the link 18, the network 20, the bus 40, and so forth, processors may be located in virtually any hardware apparatus.

The tracking device 14, in one embodiment, for example, may include a processor 50 for performing necessary data manipulation within the tracking device 14. The processor 50 may be connected to a memory device 52 by a bus 54. As in the controller 12, the tracking device may also include a storage device 56, although a storage device 56 may typically increase the size of the tracking device 14 to an undesirable degree for certain utilities.

The tracking device 14 may include a signal converter 58 for interfacing with a suite including one or more sensors 60. For example, the signal converter 58 may be an analog to digital converter, required by certain types of sensors 60. Signal processing may be provided by the processor 50. Nevertheless, certain types of sensors 60 may include a signal processor and signal converter organically included within the packaging of the sensor 60.

The sensors 60 may gather information in the form of signals sensed from the activities of the user. The sensors 60 may include a displacement sensor 62 for detecting a change of position in 1, 2, or 3 spacial dimensions. The displacement sensor 62 may be thought of as a sensor of relative position between a first location and a second location.

Alternatively, or in addition, a position sensor 64 may be provided to detect an 15 absolute position in space. For example, a displacement sensor 62 might detect the position or movement of a member of a user's body with respect to a constant frame of reference, whereas a displacement sensor 62 might simply detect motion between a first stop location and a second stop location, the starting location being reset every time the movement stops.

Each type of sensor 62, 64 may have certain advantages.

A calibrator 66 may be provided for each sensor, or for all the sensors, depending on which types of sensors 60 are used. The calibrator may be used to null the signals from sensors 60 at the beginning of use to assure that biases and drifting do not thwart the function of the system 10.

Other sensors 60 may include a velocity sensor 68 for detecting either relative speed, a directionless scalar quantity, or a velocity vector including both speed and direction. In reality, a velocity sensor 68 may be configured as a combination of a displacement sensor 62 or position sensor 64 and a clock for corresponding a position to a time.

A temperature sensor 70 may be provided, and relative temperatures may also be measured. For example, a temperature-sensing thermocouple may be placed against the skin of a user, or in the air surrounding a user's hand. Thus, temperature may be sensed electronically by temperature sensors 70.

In certain circumstances, relative humidity surrounding a user may be of importance, and may be detected by a humidity sensor 72. During exercise, and also various training, rehabilitation, and conceivably in certain high-stress virtual reality games, a heart rate sensor 74 may be included in the suite of sensors 60.

Force sensors 76 may be of a force variety or of a pressure variety. That is, transducers exist to sense a total integrated force. Alternatively, transducers also exist to detect a force per unit of area to which the force is applied, the classical definition of pressure. Thus, the force sensors 76 may include force and pressure monitoring.

With the advent of microwave imaging radar, ultrasound, magnetic resonance imaging, and other non-invasive imaging technologies, an imaging sensor 78 may be included as a sensor 60. Imaging sensors may have a processor or multiple processors organic or integrated within themselves to manage the massive amounts of data received. An imaging sensor may provide certain position data through image processing. However, the position sensor 64 or displacement sensor 62 may be a radar, such as a Doppler radar mechanism for detecting movement of a foot, leg, the rise and fall of a user's chest during breathing, or the like.

A radar system may use a target patch for reflecting its own signal from a surface, such as the skin of a user, or the surface of a shoe, the pedal of a bicycle, or the like. A radar may require much lower bandwidths for communicating with the processor 50 or the controller 12 than may be required by an imaging sensor 78. Nevertheless, the application to which the apparatus 10 is put may require either an imaging sensor 78 or a simple displacement sensor 62.

In another example a linear variable displacement transducer is a common and simple device that has traditionally been used for relative displacement. Thus, one or more of the sensors 60 described above may be included in the tracking device 14 to monitor the activity and condition of a user of the system 10.

A sensory interface device 16 may include a processor 80 and a memory device 82 connected to a bus 84. A storage device 86 may be connected to the bus 84 in some configurations, but may be considered too large for highly portable sensory interface devices 16. The sensory interface device 80 may include a power supply 88, and may include more than one power supply 88 either centrally located in the sensory interface device or distributed among the various actuators 90.

A power supply 88 may be one of several types. For example, a power supply may be an electrical power supply. Alternatively, a power supply may be a hydraulic power supply, a pneumatic power supply, a magnetic power supply, or a radio frequency power supply. Whereas, a sensor 60 may use a very small amount of power to detect a motion, an actuator 90 may provide a substantial amount of energy. The actuators 90 may particularly benefit from a calibrator 92. For example, an actuator which provides a specific displacement or motion should be calibrated to be sure that it does not move beyond a desired position, since the result could be injury to a user. As with sensors 60, the actuators may be calibrated by a calibrator 92 connected to null out any actuation of the actuator in an inactive, uncommanded mode.

In the one or more actuators 90 included in the sensory interface device 16, or connected as appendages thereto, may be an aural actuator 94. A simple aural actuator may be a sound speaker. Alternatively, an aural actuator 94 may include a synthesized sound generator as well as some speaker for projecting the sound. Thus, an aural actuator 94 may have within itself the ability to create sound on demand, and thus have its own internal processor, or it may simply duplicate an analog sound signal received from another source. One example of an aural actuator may be a compact disk player, power supply, and all peripheral devices required, with a simple control signal sent by the processor 80 to determine what sounds are presented to a user by the aural actuator 94.

An optical actuator 96 may include a computer monitor that displays images much as a television screen does. Alternatively, an optical actuator may include a pair of goggles comprising a flat panel image display, a radar display, such as an oscilloscopic catha-ray tube displaying a trace of signal, a fibre optic display of an actual image transmitted only by light, or a fibre optic display transmitting a synthetically generated image from a computer or from a compact disk reader.

Thus, in general, the optical actuator may provide an optical stimulus. In a medical application, as compared to a training, or game environment, the optical actuator may actually include electrodes for providing stimulus to optical nerves, or directed to the brain.

For example, in a virtual sight device, for use by a person having no natural sight, the optical actuator may be embodied in a sophisticated computer-controlled series of electrodes producing voltages to be received by nerves in the human body.

By contrast, in a video game providing a virtual reality environment, a user may be surrounded by a mosaic of cathode ray tube type monitors or flat panel displays creating a scene to be viewed as if through a cockpit window or other position. Similarly, a user may wear a pair of stereo goggles, having two images corresponding to the parallax views presented to each eye by a three dimensional image.

Thus, a manner and mechanism may be similar to those by which stereo aerial photographs are used. Thus a user may be shown multi-dimensional geographical features, stereo views of recorded images. Images may be generated or stored by either analog recording devices such as films.

Likewise, images may be handled by digital devices such as compact disks and computer magnetic memories. Images may be used to provide to a user in a very close environment, stereo views appearing to be three dimensional images. For example, stereo views may be displayed digitally in the two "lens" displays of goggles adapted for such use.

In addition, such devices as infrared imaging goggles, or digitized images originally produced by infrared imaging goggles, may be provided. Any of these optical actuators 96 may be adapted for use with the sensory interface device 16.

A tactile actuator 98 may be included for providing to a user a sense of touch.

Moreover, an electromuscular actuator 100 may be a part of, or connected to, the sensory interface device 16 for permitting a user to feel touched. In this regard, a temperature actuator 102 may present different temperatures of contacting surfaces or fluids against the skin of a user. The tactile actuator 98, electromuscular actuator 100, and temperature actuator 102 may interact with one another to produce a total tactile experience. Moreover, the electromuscular actuator 100 may be used to augment exercise, to give a sensation of impact, or to give feedback to a prosthetic device worn by a user in medical rehabilitation.

Examples of tactile actuators may include a pressure actuator. For example, a panel, an arm, a probe, or a bladder, may have a surface that may be moved with respect to the skin of a user. Thus, a user may be moved, or pressured. For example, a user may wear a glove or a boot on a hand or foot, respectively, for simulating certain activities. A bladder actuated by a pump, may be filled with air, water, or other working fluid to create a pressure.

With a surface of the bladder against a retainer on one side, and the skin of a user on the other side, a user may be made to feel pressure over a surface at a uniform level. Alternatively, a glove may have a series of articulated structural members, joints and connectors, actuated by hydraulic or pneumatic cylinders.

Thus, a user may be made to feel a force exerted against the inside of a user's palm or fingers in response to a grip. Thus, a user could be made to feel the grip of a machine by either a force, or a displacement of the articulated members. Conceivably, a user could arm wrestle a machine. Similarly, a user could arm wrestle a remote user, the pressure actuator 104, force actuator 106, or position actuator 108 inherent in a tactile actuator providing displacements and forces in response to the motion of a user. Each user, remote from each other, could nevertheless transfer motions and forces digitally across the worldwide web between distant systems 10.

The temperature actuator may include a pump or fan for blowing air of a selected temperature over the skin of a user in a suit adapted for such use. Alternatively, the temperature actuator may include a bladder touching the skin, the bladder being alternately filled with heated or cooled fluid, either air, water, or other working fluids.

Alternatively, the temperature actuator 102 may be constructed using thermionic devices. For example, the principle of a thermocouple may be used. A voltage and power are applied to create heat or cooling at a bimetallic junction.

These thermionic devices, by changing the polarity of the voltage applied, may be made to heat or cool electrically. Thus, a temperature actuator 102 may include a thermionic device contacting the skin of a user, or providing a source of heat or cold for a working fluid to warm or cool the skin of a user in response to the processor 80.

Referring to FIGS. 2–4, similar to the distributed nature of hardware within the apparatus 10, software for programming, operation, and control, as well as feedback may be distributed among components of the system 10. In general, in one embodiment of an apparatus in accordance with the invention, a control module 110 may be operable in the processor 30 of the controller 12.

Similarly, a tracking module 112 may run on a processor 50 of the tracking device 14. An actuation module 114 may include programmed instructions for running on a processor 80 of the sensory interface device 16.

The control module 110 may include an input interface module 116 including codes for prompting a user, receiving data, providing data prompts, and otherwise managing the data flow from the input device 36 to the processor 30 of the controller 12. Similarly, the output interface module 118 of the control module 110 may manage the interaction of the output device 38 with the processor 30 of the controller 12. The input interface module 116 and output interface module 118, in one presently preferred embodiment, may exchange data with an application module 120 in the control module 110. The application module 120 may operate on the processor 30 of the controller 12 to load and run applications 122.

Each application 122 may correspond to an individual session by a user, a particular programmed set of instructions designed for a game, an exercise workout, a rehabilitative regimen, a training session, a training lesson, or the like. Thus, the application module 120 may coordinate the receipt of information from the input interface module 116, output interface module 118, and the application 122 actually running on the processor 30.

Likewise, the application module 120 may be thought of as the highest level programming running on the processor 30. Thus, the application module 120 may exchange data with a programming interface module 124 for providing access and control by a user to the application module 120.

For example the programming interface module 124 may be used to control and transfer information provided through a keyboard connected to the controller 12. Similarly, the programming interface module may include software for downloading applications 122 to be run by the application module 120 on the processor 30 or to be stored in the storage device 34 for later running by the processor 30.

The input interface module 116 may include programmed instructions for controlling the transfer of information, for example, digital data, between the application module 120 of the control module 110 running on the processor 30, and the tracking device 14. Correspondingly, the output interface module 118 may include programmed instructions for transferring information between the application module 120 and the sensory interface device 16.

The input interface module 116 and output interface module 118 may deal exclusively with digital data files or data streams passed between the tracking device 14 and the sensory interface device 16 in an embodiment where each of the tracking device 14 and sensory interface device 16 are themselves microprocessor controlled with microprocessors organic (integral) to the respective structures.

The control module 10 may include an interaction module 128 for transferring data between control modules 110 of multiple, at least two, systems 10. Thus, within the controller 12, an interaction module 128 may contain programmed instructions for controlling data flow between an application module 120 in one location and an application module 120 of an entirely different system 10 at another location, thus facilitating a high level of coordination between applications 122 on different systems 10.

If a controller 12 operates on a network 20, or an internetwork beyond a router 24 connected to a local area network 20 of the controller 12, a network module 126 may contain programmed instructions regarding logging on and off of the network, communication protocols over the network, and the like. Thus, the application module 120 may be regarded as the heart of the software running on the controller 12, or more precisely, on the processor 30 of the controller 12. Meanwhile, the functions associated with network access may be included in a network module 126, while certain interaction between cooperating systems 10 may be handled by an interaction module 128.

Different tasks may be reassigned to different software modules, depending on hardware configurations of a specific problem or system 10. Therefore, equivalent systems 10 may be configured according to the invention. For example, a single application 122 may include all of the functions of the modules 120–128.

In a controller 12, more than one processor 30 may be used. Likewise, a multi-tasking processor may be used as the processor 30. Thus, multiple processes, threads, programs, or the like, may be made to operate on a variety of processors, a plurality of processors, or in a multi-tasking arrangement on a multi-tasking processor 30. Nevertheless, at a high level, data may be transferred between a controller 12 and a tracking device 14, the sensory interface device 16, a keyboard, and monitor, a remote controller, and other nodes on a network 20.

The tracking module 112 may include a signal generator 130. In general, a signal generator may be any of a variety of mechanisms operating within a sensor, to create a signal. The signal generator 130 may then pass a signal to a signal converter 132. For example, an analog to digital converter may be common in certain transducers. In other sophisticated transducers, a signal generator 130 may itself by microprocessor-controlled, and may produce a data stream needing no conversion by a signal converter 132.

In general, a signal converter 132 may convert a signal from a signal generator 130 to a digital data signal that may be processed by a signal processor 134. A signal processor 134 may operate on the processor 30 of the controller 12, but may benefit from distributive processing by running on a processor 50 in the tracking device 14. The signal processor 134 may then interact with the control module 110, for example, by passing its data to the input interface module 116 for use by the application module 120 or application 122.

The signal generator 130 generates a signal corresponding to a response 136 by a user. For example, if a user moves a finger in a data glove, a displacement sensor 62 or position sensor 64 may detect the response 136 of a user and generate a signal.

Similarly, a velocity sensor 68 or force sensor 76 may do likewise for a similar motion. The temperature sensor 70 or humidity sensor 72 may detect a response 136 associated with increase body temperature or sweating. Likewise, the heart rate sensor 74 and imaging sensor 78 may return some signal corresponding to a response 136 by a user. Thus, the tracking device 14 with its tracking module 112 may provide data to the controller 110 by which to determine inputs by the control module 110 to the sensory interface device 114.

An actuation module 114 run on the processor 80 of the sensory interface device 16 may include a driver 140, also referred to as a software driver, for providing suitable signals to the actuators 90. The driver 140 may control one or more power supplies 142 for providing energy to the actuators 90. The driver 140 may also provide actuation signals 144 directly to an actuator 90.

Alternatively, the driver 140 may provide a controlling instruction to a power supply 142 dedicated to an actuator 90, the power supply, thereby, providing an actuation signal 144. The actuation signal 144 provided to the actuator 90 results in a stimulus signal 146 as an output of the actuator 90.

For example, a stimulus signal for an aural actuator 94 may be a sound produced by a speaker. A stimulus signal from an optical actuator 96 may be a visual image on a screen for which an actuation signal is the digital data displaying a CRT image.

Similarly, a stimulus signal for a force actuator 106 or a pressure actuator 104 may be a pressure exerted on the skin of a user by the respective actuator 90. A stimulus signal 146 may be a heat flow or temperature driven by a temperature actuator 100. A stimulus signal 146 of an electromuscular actuator 100 may actually be an electric voltage, or a specific current.

That is, an electromuscular actuator 100 may use application of a voltage directly to each end of a muscle to cause a natural contraction, as if a nerve had commanded that muscle to move. Thus, an electromuscular actuator 100 may include a power supply adapted to provide voltages to muscles of a user.

Thus, a plurality of stimulus signals 146 may be available from one or more actuators 90 in response to the actuation signals 144 provided by a driver 140 of the actuation module 114.

Referring now to FIG. 4, the data structures for storage, retrieval, transfer, and processing of data associated with the system 10 may be configured in various ways. In one embodiment of an apparatus 10 made in accordance with the invention, a set up database 150 may be created for containing data associated with each application 122. Multiple set up data bases 150.

An operational data base 152 may be set up to contain data that may be necessary and accessible to the controller 12, tracking device 14, sensory interface device 16 or another remote system 10. The set up data base 150 and operational data base 152 may reside on the server 22.

To expedite the transfer of data and the rapid interaction between systems 10 remote from one another, as well as between the tracking device 14, sensory interface device 16, and controller 12, certain data may be set up in a sensor table 156. The sensor table 156 may contain data specific to one or more sensors 60 of the tracking device.

Thus, the complete characterization of a sensor 60 may be placed in a sensor table 156 for rapid access and interpolation, during operation of the application 122. Similarly, an actuator table 158 may contain the information for one or more actuators 90. Thus, the sensor table 156 and the actuator table 158 may contain information for more than one sensor 60 or actuator 90, respectively, or may be produced in plural, each table 156, 158 corresponding to each sensor 60 or actuator 90, respectively.

In operation, the tables 156, 158 may be used for interpolating and projecting expected inputs and outputs related to sensors 60 and actuators 90 so that a device communicating to or from such sensor 60 or actuator 90 may project an expected data value rather than waiting until the value is generated. Thus, a predicted response may be programmed to be later corrected by actual data if the direction of movement of a signal changes. Thus, the speed of response of a system 10 may be increased.

To assist in speeding the transfer of information, the various methods of linking operational data bases 152 may be provided. For example, a linking index 154 may exchange data with a plurality of operational data bases 152 or with an operational data base and a sensor table 156 or actuator table 158. Thus, a high speed indexing linkage may be provided by a linking index 154 or a plurality of linking indices 154 rather than slow-speed searching of an operational data base 152 for specific information needed by a device within the system 10.

A remote apparatus 11 may be connected through the network 20 or through an intemetwork 25 connected to the router 24. The remote system 11 may include one or more corresponding data structures. For example, the remote system 11 may have a corresponding remote set up data base 160, remote operational data bases 162, remote linking data bases 164, remote sensor tables 166, and remote actuator tables 168. Moreover, interfacing indices may be set up to operate similar to the linking indices 154, 164.

Thus, on the server 22, a controller 12 may have an interface index 170 for providing high speed indexing of data that may be made rapidly accessible, to eliminate the need to continually update data, or search data in the systems 10, 11. Thus, interpolation, projection, and similar techniques may be used as well as high speed indexing for accessing the needed information in the remote system 11, by a controller 12 having access to an interfacing index 170. An interfacing index 170 may be hosted on both the server 22 and a server associated with the remote system 11.

Figure 5:
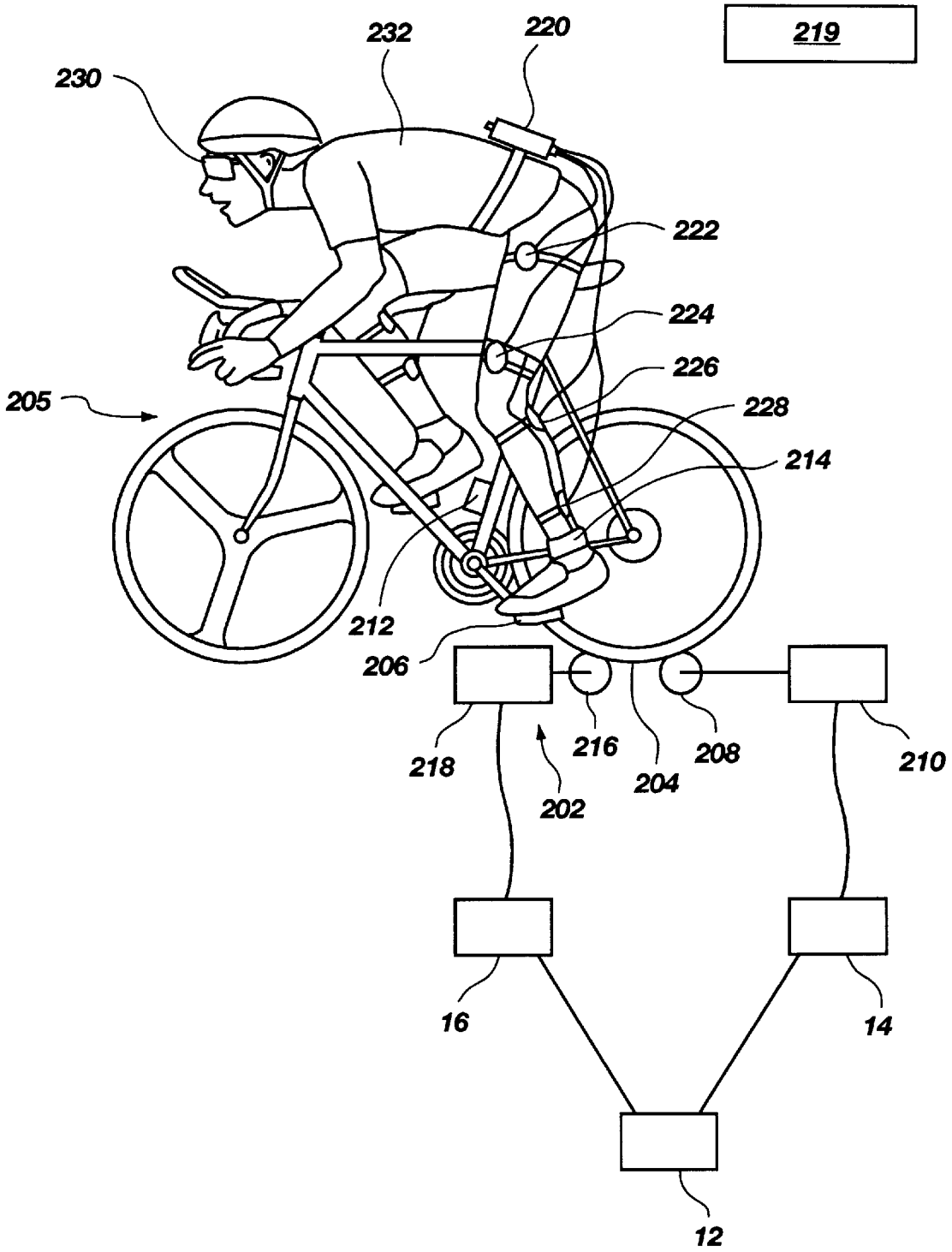
FIG. 5 is a schematic block diagram of one embodiment of the apparatus of FIG. 1 adapted to tracking and actuation, including electromuscular stimulation, of a user of a stationary bicycle exerciser.

FIG. 5 illustrates one embodiment of an apparatus made in accordance with the invention to include a controller 12 operably connected to a tracking device 14 and a sensory interface device 16 to augment the experience and exercise of a user riding a bicycle. The apparatus may include a loading mechanism 202 for acting on a wheel 204 of a bicycle 205

For example a sensing member 208 may be instrumented by a wheel and associated dynamometer, or the like, as part of an instrumentation suite 210 for tracking speed, energy usage, acceleration, and other dynamics associated with the motion of the wheel 204. Similarly loads exerted by a user on pedals of the bicycle 205 may be sensed by a load transducer 206 connected to the instrumentation suite 210 for transmitting signals from the sensors 60 to the tracking device 14. In general, an instrumentation suite 210 may include or connect to any of the sensors 60. The instrumentation suite 210 may transmit to the tracking device 14 tracking data corresponding to the motion of the sensing member 208.

A pickup 212 such as, for example, a radar transmitting and receiving unit, may emit or radiate a signal in a frequency range selected, for example, from radio, light, sound, or ultrasound spectra. The signal may be reflected to the pickup 212 by a target 214 attached to a bodily member of a user for detecting position, speed, acceleration, direction, and the like. Other sensors 60 may be similarly positioned to detect desired feedback parameters.

A resistance member 216 may be positioned to load the wheel 204 according to a driver 218 connected to the sensory interface device 16. Other actuators 90 may be configured as resistance members to resist motion by other bodily members of a user, either directly or by resisting motion of mechanical members movable by a user. The resistance member 216, as many actuators 90, devices for providing stimuli, may be controlled by a combination of one or more inputs.

Such inputs may be provided by pre-inputs, programmed instructions or controlling data pre-programmed into setup databases 150, 160, actuator tables 158, 168 or operational databases 152, 162. Inputs may also be provided by user-determined data stored in the actuator tables 158, 168 or operational databases 152, 162. Inputs may also be provided by data corresponding to signals collected from the sensors 60 and stored by the tracking device 14 or controller 12 in the sensor tables 156, 166, actuator tables 158, 168 or operational databases 152, 162.

The display 230 may be selected from a goggle apparatus for fitting over the eyes of a user to display an image in one, two, or three dimensions. Alternatively, the display 230 may be a flat panel display, a cathode ray tube (CRT), or other device for displaying an image.

In other alternative embodiment of the invention, the display 230 may include a "fly's eye" type of mosaic. That is, a wall, several walls, all walls, or the like, may be set up to create a room or other chamber. The chamber may be equipped with any number of display devices, such as, for example, television monitors, placed side-by-side and one above another to create a mosaic.

Thus, a user may have the impression of sitting in an environment looking out a paned window on the world in all dimensions. Thus, images may be displayed on a single monitor of the display 230, or may be displayed on several monitors. For example, a tree, a landscape scene at a distance, or the like may use multiple monitors to be shown in full size as envisioned by a user in an environment.

Thus a display 230 may be selected to include goggle-like apparatus surrounding the eyes and showing up to three dimensions of vision. Alternatively, any number of image presentation monitors may be placed away from the user within a chamber.

The display 230 may be controlled by hard wire connections or wireless connections from a transceiver 219. The transceiver 219 may provide for wireless communication with sensory interface devices 16, tracking devices 14, sensors 60, or actuators 90.

For example, the transceiver 219 may communicate with an activation center 220 to modify or control voltages, currents, or both delivered by electrodes 222, 224 attached to stimulate action by a muscle of the user. Each pair of electrodes 222, 224 may be controlled by a combination of open loop control (e.g. inputs from a pre-programmed code or data), man-in-the-loop control, (e.g. inputs from a user input into the controller 12 by way of the programming interface module 124), feedback control (e.g. inputs from the tracking system 14 to the controller 12), or any combination selected to optimize the experience, exercise, or training desired.

This combination of inputs for control of actuators 90 also may be used to protect a user. For example, the controller 12 may override pre-programmed inputs from a user or other source stored in databases 150, 152 and tables 156, 158 or inherent in software modules 110, 112, 114 and the like. That is, the feedback corresponding to the condition of a user as detected by the sensors 60, may be used to adjust exertion and protect a user.

Likewise, the activation center 220 may control other similarly placed pairs of electrodes 226, 228. If wires are used, certain bandwidth limitations may be relaxed, but each sensor 60, actuator 90, or other device may have a processor and memory organic or inherent to itself. Thus, all data that is not likely to change rapidly may be downloaded, including applications, and session data to a lowest level of use. In many cases data may be stored in the controller 12.

Session data may be information corresponding to positions, motion, condition, and so forth of an opponent. Thus, much of the session data in the databases 160, 162 and tables 166, 168 may be provided to the user and controller 12 associated with the databases 150, 152 and tables 156, 158 for use during a contest, competition, or the like. Thus, the necessary data traffic passed through the transceiver 219 of each of two or more remotely interacting participants (contestants, opponents, teammates, etc.) may be minimized to improve real time performance of the system 10, and the wireless communications of the transceiver.

An environmental suit 232 may provide heating or cooling to create an environment, or to protect a user from the effects of exertion. Actuation of the suit 232 may be provided by the sensory interface device 16 through hard connections or wirelessly through the transceiver 219. Thus, for example, a user cycling indoors may obtain needed additional body cooling to facilitate personal performance similar to that available on an open road at 30 mile-per-hour speeds. The environment suit may also be provided with other sensors 60 and actuators 90.

An apparatus in accordance with the invention may be used to create a duplicated reality, rather than a virtual reality. That is, two remote users may experience interaction based upon tracking of the activities of each. Thus, the apparatus 10 may track the movements of a first user and transmit to a second user sufficient data to provide an interactive environment for the second user. Meanwhile, another apparatus 10 may do the equivalent service for certain activities of the second user. Feedback on each user may be provided to the other user. Thus, rather than a synthesized environment, a real environment may be properly duplicated.

For example, two users may engage in mutual combat in the martial arts. Each user may be faced with an opponent represented by an image moving through the motions of the opponent. The opponent, meanwhile, may be tracked by an apparatus 10 in order to provide the information for creating the image to be viewed by the user.

In one embodiment of an apparatus 10 made in accordance with the invention, for example, two competitors may run a bicycle course that is a camera-digitized, actual course. Each competitor may experience resistance to motion, apparent wind speed, and orientation of a bicycle determined by actual conditions on an actual course. Thus, a duplicated reality may be presented to each user, based on the actual reality experienced by the other user. Effectively, a hybrid actual/duplicate reality exists for each user.

Two users, in this example, may compete on a course not experienced by either. Each may experience the sensations of speed, grade, resistance, and external environment. Each sensation may be exactly as though the user were positioned on the course moving at the user's developed rate of speed. Each user may see the surrounding countryside pass by at the appropriate speed.

Moreover, the two racers could be removed great distances from one another, and yet compete on the course, each seeing the image of the competitor. The opposing competitor's location, relative to the speed of each user, may be reflected by each respective image of the course displayed to the users.

Electromuscular stimulation apparatus 100 may be worn to assist a user to exercise at a speed, or at an exertion level above that normally experienced. Alternatively, the EMS may be worn to ensure that muscles do experience total exertion in a limited time. Thus, for example, a user may obtain a one hour workout from 30 minutes of activity. Likewise, in the above examples of two competitors, one competitor may be handicapped. That is one user may receive greater exertion, a more difficult workout, against a lesser opponent, without being credited with the exertion by the system. A cyclist may have to exert, for example, ten percent more energy that would actually be required by an actual course. The motivation of having a competitor close by could then remain, while the better competitor would receive a more appropriate workout. Speed, energy, and so forth may also be similarly handicapped for martial arts contestants in the above example.

In another example, a skilled mechanic may direct another mechanic at a remote location. Thus, for example, a skilled mechanic may better recognize the nature of an environment or a machine, or may simply not be available to travel to numerous locations in real time. Thus, a principal mechanic on a site may be equipped with cameras. Also, a subject machine may be instrumented.

Then, certain information needed by a consulting mechanic located a distance away from the principal mechanic may be readily provided in real time. Data may be transmitted dynamically as the machine or equipment operates. Thus, for example, a location or velocity in space may be represented by an image, based upon tracking information provided from the actual device at a remote location.

Thus, one physical object may be positioned in space relative to another physical object, although one of the objects may be a re-creation or duplication of its real object at a remote location. Rather than synthesis (a creation of an imaginary environment by use of computed images), an environment is duplicated (represented by the best available data to duplicate an actual but remote environment).

One advantage of a duplicated environment rather than a synthesized environment is that certain information may be provided in advance to an apparatus 10 controlled by a user. Some lesser, required amount of necessary operational data may be passed from a remote site. A machine, for example, may be represented by images and operational data downloaded into a file stored on a user's computer.

During operation of the machine, the user's computer may provide most of the information needed to re-create an image of the distant machinery. Nevertheless, the actual speeds, positioning, and the like, corresponding to the machine, may be provided with a limited amount of required data. Such operation may require less data and a far lower bandwidth for transmission.

In one embodiment, the invention may include a presentation of multiple stimuli to a user, the stimuli including an image presented visually. The apparatus 10 may then include control of actuators 90 by a combination of pre-inputs provided as an open loop control contribution by an application, data file, hardware module, or the like. Thus, pre-inputs may include open-loop controls and commands.

Similarly, user-selected inputs may be provided. A user, for example, may select options or set up a session through a programming interface module 124. Alternatively, a user may interact with another input device connected to provide inputs through the input module 116. The apparatus 10 may obtain a performance of the system 10 in accordance with the user-selected inputs. Thus, a "man-in-the-loop" may exert a certain amount of control.

In addition to these control functions, the sensors 60 of the tracker device 14 may provide feedback from a user. The feedback, in combination with the user-selected data and the pre-inputs, may control actuators 90 of the sensory interface device 16. The apparatus 10 may provide stimuli to a user at an appropriate level based on all three different types of inputs. The condition of a user as indicated by feedback from a sensor 60 may be programmed to override a pre-input from the controller 12, or an input from a user through the programming interface module 124.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed and desired to be secured by United States Letters Patent is:

1. A method of exercising comprising:

inputting a process parameter signal into an input device for operating an executable program in a processor of a controller, the process parameter signal corresponding to data required by the executable program;

inputting a user selection signal into the input device, the user selections corresponding to optional data selectable by a user and useable by the executable program;

tracking a condition of a user by a tracking device, the condition being selected from a spatial position, a relative displacement, a velocity, a speed, a force, a pressure, an environmental temperature, and a pulse rate corresponding to a bodily member of a user, and the tracking device comprising a sensor selected from a position detector, motion sensor, accelerometer, radar receiver, force transducer, pressure transducer, temperature sensor, heart rate detector, humidity sensor, and imaging sensor;

processing the process parameter signal, the user selection signal, and a sensor signal from the tracking device, the sensor signal being received by the controller operably connected to the tracking device, to provide an actuator signal to a sensory interface device operably connected to the controller to control an actuator; and providing directly to a bodily member of a user a stimulus corresponding to the process parameter signal, the user selection signal, and the sensor signal.

2. The method of claim 1 further comprising setting a control of an electromuscular stimulation device to deliver sensory impact to muscles of a user at interactively determined times, the electromuscular stimulation device comprising a power supply, a voltage source connected to the power supply, a timing control connected between the voltage source and a plurality of electrodes secured to the body of a user to actuate selected muscles, the timing control being controlled by the controller in accordance with settings input by a user, pre-programmed control parameters, and feedback signals corresponding to a selected condition of a user provided from the tracking device.

3. A method comprising:

providing a processor, for executing an executable, an actuator operably connected to the processor, and a memory device for storing data structures to be used by the processor;

inputting a process parameter signal for controlling the executable;

inputting a user selection signal for controlling use of optional data in the data structures;

tracking a condition of a user;

providing a sensor signal reflecting the condition;

processing the process parameter, user selection signal, and sensor signal, by the executable; and providing, by the actuator, a stimulus directly to a user, the stimulus corresponding to the process parameter, user selection signal, and sensor signal.

4. The method of claim 3, wherein the data structures include the executable.

5. The method of claim 4, wherein tracking further comprises providing a sensor for receiving condition inputs reflecting the condition.

6. The method of claim 5, wherein the sensor is configured to sense a condition selected from a position, speed, acceleration, humidity, temperature, and force.

7. The method of claim 1, further comprising providing an actuation device for stimulating a user directly.

8. The method of claim 7, further comprising providing a controller operably connected to the actuation device for integrating information corresponding to the condition of a user and inputs provided by the controller independently from a user.

9. The method of claim 8, further comprising providing a tracking device operably connected to communicate to the controller the condition of a user.

10. The method of claim 9, further comprising providing an electromuscular stimulation device operably connected to the controller to provide the stimulation directly to a user.

11. The method of claim 10 wherein the tracking device further comprises a sensor selected from a position detector, motion sensor, accelerometer, radar receiver, force transducer, pressure transducer, temperature sensor, heart rate detector, humidity sensor, and imaging sensor.

12. The method of claim 11 wherein the sensor is selected from an imaging sensor, a senor reflecting dynamics of a user, a transducer reflecting kinematics of a user, and a biological sensor for indicating a state of a biological function of a user.

13. A method of training, comprising:

providing an actuation device sensible by a user;

providing a controller for receiving feedback data corresponding to a condition of a user, and controlling the actuation device;

communicating data reflecting a condition of a user to the controller with a tracking device;

programing the controller to execute an executable independent from auser for controlling a stimulus to a user based on data from the tracking device; and operably connecting the actuator device to the controller and tracking device for providing the stimulus directly to a user; and tracking a condition of a user.

14. The method of claim 13, further comprising controlling the stimulus in accordance with the condition of a user.

15. The method of claim 13 wherein providing the actuation device further comprises providing an electromuscular stimulation device comprising a receiver and further comprising receiving input signals corresponding to the user data and feedback data with the receiver.

16. The method of claim 13 further comprising providing a sensor signal reflecting a condition of the user detected by an imaging sensor, the imaging sensor being selected from a magnetic resonance imaging device, a sonar imaging device, an ultrasonic imaging device, an x-ray imaging device, an imaging device operating in the infrared imaging spectrum, an imaging device operating in the ultraviolet spectrum, an imaging device operating in the visible light spectrum, a radar imaging device, and a tomographic imaging device.

17. The method of claim 13 further comprising detecting a condition of a user with the sensor of the tracking device, the sensor of the tracking device including a transducer selected from detectors for detecting spatial position, a relative displacement, a velocity, a speed, a force, a pressure, an environmental temperature, and a pulse rate corresponding to a bodily member of a user.

18. The method of claim 13 further comprising detecting a position of a bodily member of a user with the sensor, the sensor being selected from a radar receiver, a gyroscopic device for establishing spatial position, a global positioning system detecting a target positioned on the bodily member from a plurality of sensors spaced from one another and from the bodily member, and an imaging system adapted for detecting, recording, and interpreting positions of bodily members of a user and processing data corresponding to the positions to provide outputs from the tracking device to the controller.

19. The method of claim 13 wherein the tracking device includes an instrumented, movable member incorporated into an article of body wear and wherein communicating data reflecting a condition of a user to the controller with a tracking device further comprises placing the tracking device proximate a bodily member of the user.

20. The method of claim 19 further comprising placing the article of body wear on a user, the article of body wear being selected from a sleeve fittable to an arm of a user, a glove, a hat, a helmet, a sleeve fittable to a torso of a user, a sleeve fittable to a leg of a user, a stocking fittable to a foot of a user, a boot, and a suit fittable to arms, torso and legs of a user.

* * * * *